United States Patent [19]

Heid

[11] Patent Number: 4,796,931

[45] Date of Patent: Jan. 10, 1989

[54] EXIT DEVICE HAVING ADJUSTABLE BACKSET

[75] Inventor: George E. Heid, Charlotte, N.C.

[73] Assignee: Yale Security Inc., Monroe, N.C.

[21] Appl. No.: 82,749

[22] Filed: Aug. 7, 1987

[51] Int. Cl.[4] ..... E05B 65/10

[52] U.S. Cl. ..... 292/92; 292/337; 292/DIG. 53; 292/DIG. 60

[58] Field of Search ..... 292/92, 21, 337, DIG. 60, 292/DIG. 53

[56] References Cited

U.S. PATENT DOCUMENTS

| | | | |
|---|---|---|---|
| 2,719,744 | 10/1955 | Schlage | 292/337 |
| 3,614,145 | 10/1971 | Zawadzki | 292/92 |
| 3,663,047 | 5/1972 | Zawadzki | 70/92 |
| 3,730,574 | 5/1973 | Zawadzki | 70/92 |
| 3,767,238 | 10/1973 | Zawadzki | 292/21 |
| 3,854,763 | 12/1974 | Zawadzki et al. | 292/201 |
| 3,877,262 | 4/1975 | Williams | 70/92 |
| 4,083,590 | 4/1978 | Folger | 292/92 |
| 4,099,753 | 7/1978 | Gwozdy et al. | 292/92 X |
| 4,167,280 | 9/1979 | Godec et al. | 292/92 |
| 4,295,673 | 10/1981 | Miller | 292/21 |
| 4,427,224 | 1/1984 | Bergen | 292/1 |
| 4,598,939 | 7/1986 | Krupicka et al. | 292/92 |
| 4,623,174 | 11/1986 | Trull et al. | 292/1 |
| 4,624,490 | 11/1986 | Miller | 292/92 |

FOREIGN PATENT DOCUMENTS 1579921 11/1980 United Kingdom .

*Primary Examiner*—Richard E. Moore

*Attorney, Agent, or Firm*—Dallett Hoopes

[57] ABSTRACT

An exit device providing adjustable backset. This is achieved by having the touch bar linked to a driven element adjacent the base plate of the unit and the latch mechanism linked to an activator element also adjacent the base plate. These two elements are coupled by a sliding drive plate having a plurality of sets of apertures spaced along it to receive both elements respectively in a selected set. An exterior operator of specified backset is provided and connects with a cam adjacent an end of the drive plate to slide the plate when the exterior operator is moved. By selecting the proper set of apertures for the elements the installer can see that the cam is at the proper backset and therefore aligned with the operator.

9 Claims, 3 Drawing Sheets

EXIT DEVICE HAVING ADJUSTABLE BACKSET

BACKGROUND OF THE INVENTION

1. Field of the Invention

This invention relates to an emergency exit device as is commonly used on the inside of a door to a public building. More specifically, the invention relates to an exit device of the touch bar type which is adapted to accommodate different backset distances for the trim on the outside of the door.

2. Discussion of the Prior Art

The prior art includes a large number of patents relating to emergency exit devices of the touch bar type. In each of these devices, a touch bar is mounted across the door to be depressed as the occupant desires to open the door. Depressing of the touch bar, which moves it from extended position outward of the door to an inward position, retracts the door latch, which may be either in the form of a rim latch or through vertical rods, ceiling and floor latches. Examples of such devices are shown in the following patents British Patent Specification No. 1,579,921 published Nov. 26, 1980 to Adams Rite U.S. Pat. No. 3,614,145 issued October 19, 1971 to Zawadzki U.S. Pat. No. 3,663,047 issued May 16, 1972 to Zawadski U.S. Pat. No. 3,730,574 issued May 1, 1973 to Zawadzki U.S. Pat. No. 3,767,238 issued October 23, 1973 to Zawadski U.S. Pat. No. 3,854,763 issued Dec. 17, 1974 to Zawadski et al U.S. Pat. No. 3,877,262 issued April 15, 1975 to Williams U.S. Pat. No. 4,083,590 issued April 11, 1978 to Folger U.S. Pat. No. 4,167,280 issued Sept. 11, 1979 to Godec et al U.S. Pat. No. 4,295,673 issued Oct. 20, 1981 to Miller U.S. Pat. No. 4,598,939 issued July 8, 1986 to Krupicka et al U.S. Pat. No. 4,624,490 issued Nov. 25, 1986 to Miller Architectural requirements today require that the trim on the outside of the door be at different locations measured in from the door edge, depending on the on the stile and width of the door. While the prior art includes locksets which accommodate different backsets—an example being found in U.S. Pat. No. 4,623,174, which issued on Nov. 18, 1986, to Trull et al., inventor—there has been a need for an exit device which would provide adjustment to alternate backsets.

SUMMARY OF THE INVENTION

To satisfy this need the present invention is an exit device providing adjustable backset. This is achieved by having the touch bar linked to a driven element adjacent the base plate of the unit and the latch mechanism linked to an activator element also adjacent the base plate. These two elements are coupled by a sliding drive plate having a plurality of sets of apertures spaced along it to receive both elements respectively in a selected set. An exterior operator of specified backset is provided and connects with a cam adjacent an end of the drive plate to slide the plate when the exterior operator is moved. By selecting the proper set of apertures for the elements the installer can see that the cam is at the proper backset and therefore aligned with the operator.

BRIEF DESCRIPTION OF THE DRAWINGS

Other features and objects of the invention will be apparent from the following specification and the attached drawings, all of which disclose a non-limiting but preferred form of the invention. In the drawings.

DESCRIPTION OF THE PREFERRED EMBODIMENT

Figure 1:
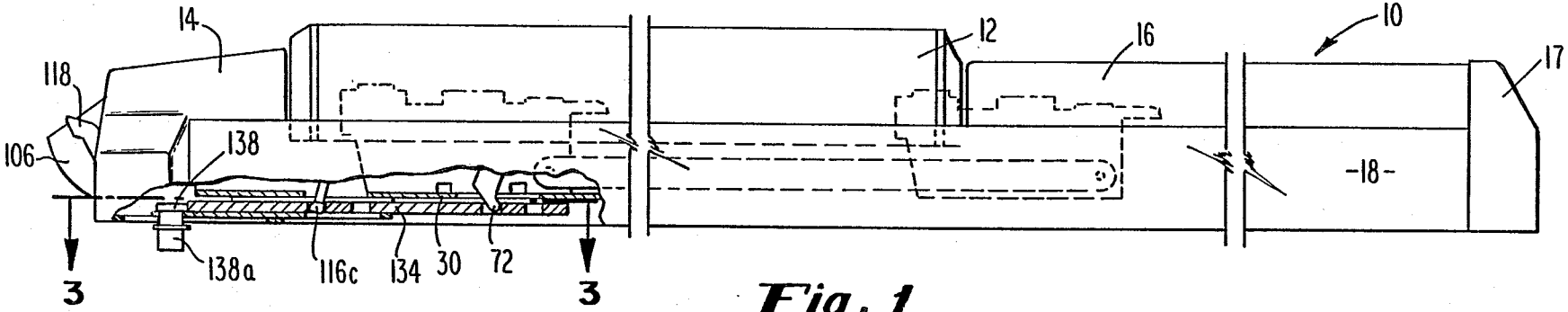
FIG. 1 is a bottom plan view of an exit device embodying the invention having parts shown in phantom and sections broken away to show the mechanism which accommodates different backset distances.

Referring more specifically to the drawings, an exit device embodying the invention is shown in FIG. 1 and designated 10. It comprises a touch bar 12, a latch housing 14 and a cover plate 16 having end cap 17. A U-shaped shield 18 (FIG. 6) including the bight or web section 20 hugs around and slides over a frame 22 comprising side rails 24 and a base plate 30. Bight section 20 is adapted to be mounted flat against the door.

Figure 4:
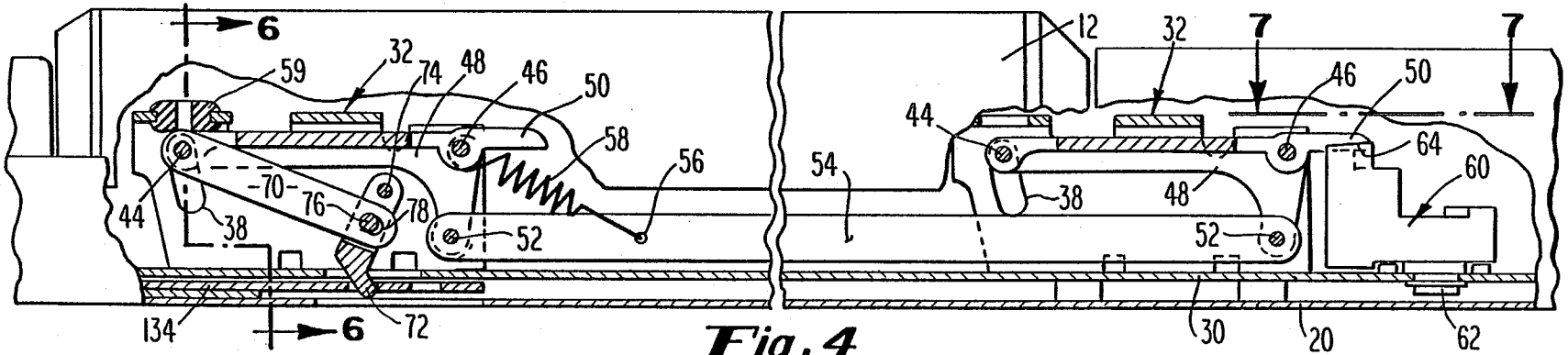
FIG. 4*a* is an enlarged fragmentary bottom plan view broken away to show the operation of the touch bar.

Secured to the base plate 30 is a pair of identical spaced touch bar mounts 32 which include inverted U-shaped elements having sidewalls 34, ends of which extend down through appropriate apertures in the base plate 30. Mounting flanges 36 are struck out from the legs of walls 34 and are secured to the base plate 30 by rivets. As shown in FIG. 4, the sidewalls 32 are slotted as at 38 in an arc for reasons which will appear.

The touch bar 12 (FIG. 6) is an elongated extrusion having an upper pressing pad 40 bulged out on its sides and a pair of oppositely facing spaced parallel cheeks 42 extending downward. Pins 44 are rigidly mounted between the cheeks and extend through the slots 38 of the mounts 32 respectively.

On each mount 32 at the opposite end from the slot 38 a pin 46 pivotally supports at its vertex an L-shaped lever 48 between the walls 34. The lever 48 includes a rearwardly extending projection 50. The long leg of the L-shape lever 48 is connected at its distal end to the pin 44 which travels in the slot 38. The shorter leg of the lever 48 at its end is pivotally connected by pin 52 to the stabilizing link 54.

Figure 5:
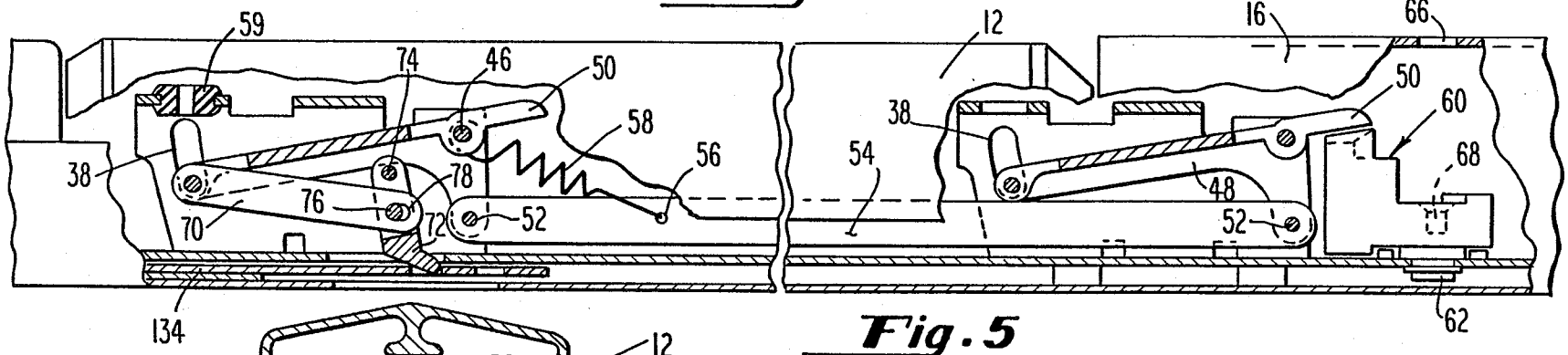
FIG. 5 is similar to FIG. 4 but showing the touch bar depressed.

The link is apertured at 56 and a spring 58 connects the aperture 56 and the pin 46 on the leftward mount to urge the stabilizing link 54 leftward (FIG. 5). This causes a clockwise movement of the levers 48 about their mounting pins 46 to urge the pins 44 upward, as shown in FIG. 4, and the touch bar 12 to its outermost position. A rubber bumper 59 is mounted in an opening in the top of the mount 32 to cushion the end of travel of the longer leg of the lever 48.

To the side of the touch bar 12 a dogging cam 60 is formed on its underside with a boss 62, which extends through an opening in the base plate 30, to mount the cam for rotation about the boss. A retaining ring is provided on the boss on the opposite side of the base plate 30 to keep the cam in its proper axial position. At its end opposite the base plate the cam is formed with a camming surface 64 adjacent and under projection 50. In practice an Allen wrench may be inserted through aperture 66 in the cover 16 to fit into a shaped opening 68 to rotate the dog cam 60. This will drive the projection 50 upward as the cam surface 64 works against it and may be used to hold the touch bar in its innermost position, keeping the latch retracted, as will be explained.

Figure 6:
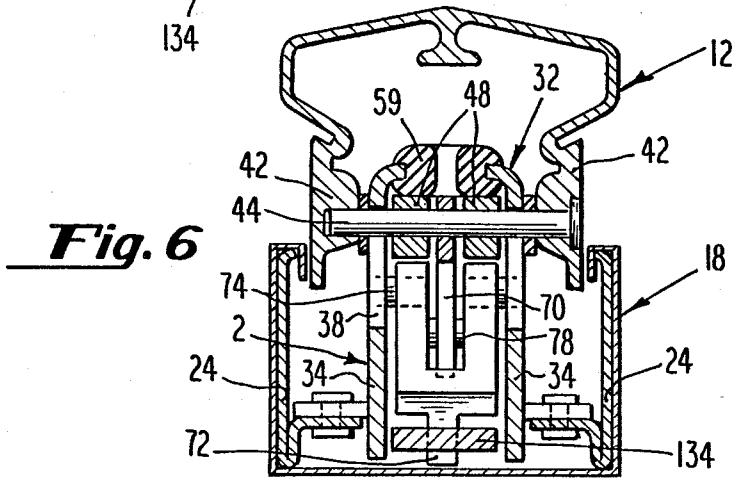
FIG. 6 is a sectional view taken on the line 6—6 of FIG. 4.

Pivotally engaging the pin 44 is the pusher 70. A finger 72 is pivotally mounted by pin 74, which bridges between the walls 34 of the leftward mount 32. The finger 72 extends downward from pin 74 and terminates in a rounded drive end. Intermediate its ends the finger, which is bifurcated, as shown in FIG. 6, is provided with a driving pin 76 which is disposed in an opening 78 (FIG. 4) in the opposite end of the pusher 70. Opening 78 may be a slot to provide some lot motion, to be explained.

The result of the structure described so far is that as the touch bar 12 is depressed the pins 44 move inward together because of the leveling and stabilizing effect of the stabilizer 54, which comprises, in effect, one side of a parallelogram or four-bar linkage. Progressive inward movement of the pins 44 causes the pusher 70 to pivot the finger 72 about its mounting pin 74 the lower end of the finger moving in a rightward direction (FIG. 4). When the touch bar 12 is at its most depressed position, finger 72 is to its rightward limit of travel and may be held there, if desired, by setting the dogging cam 60, as described, in a position to hold up projection 50. However, if the dogging cam 60 is not in its working position holding up the projection 50, the touch bar will rise, urged by spring 58, when manual pressure on the touch bar is withdrawn.

Figure 8:
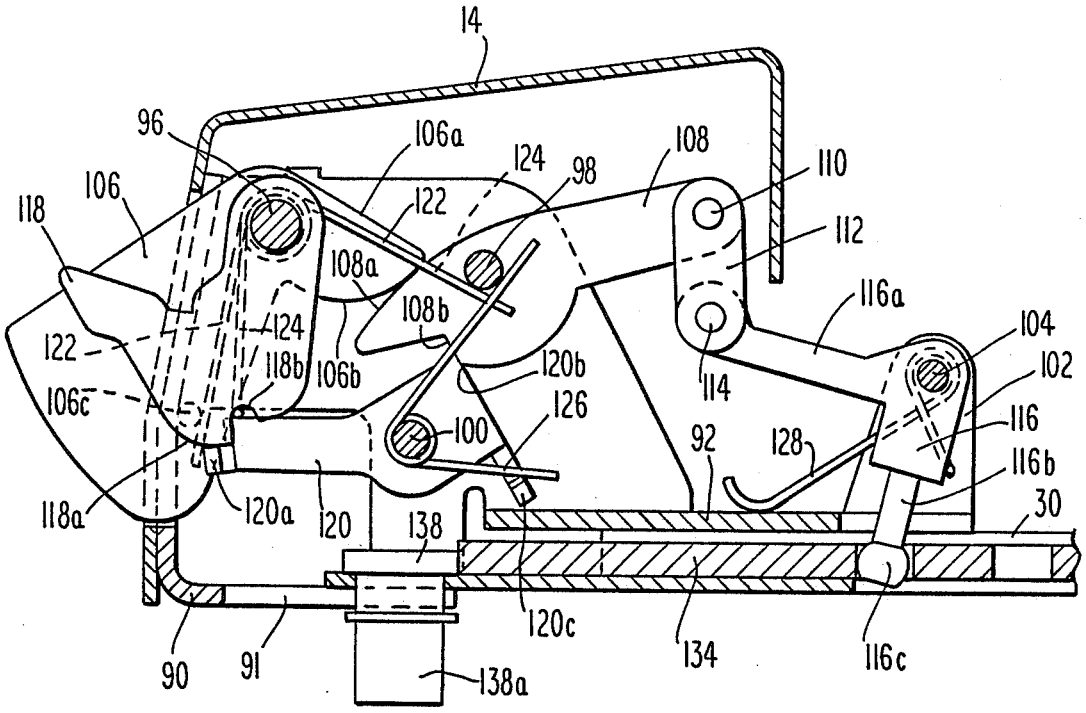
FIG. 8 is an enlarged sectional bottom plan view of the large mechanism with the latch extended.
Figure 9:
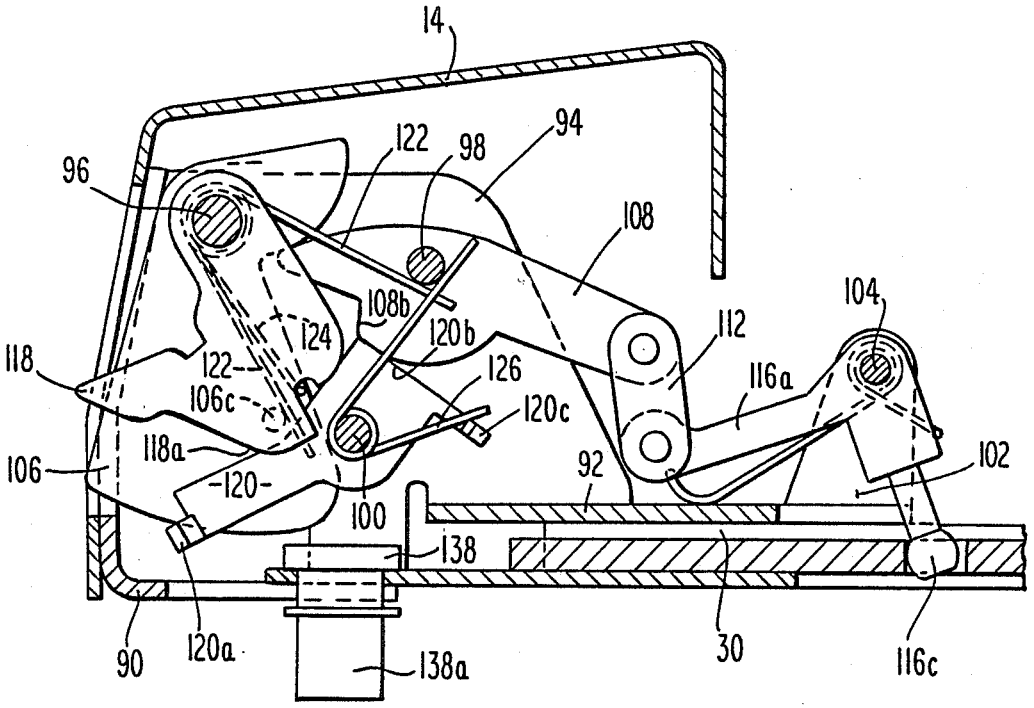
FIG. 9 is similar to FIG. 8 but showing the latch in retracted condition.

Referring now to FIGS. 8 and 9, the latch mechanism is mounted on a base fixture 90 to which the cover 14 is secured. Fixture 90, which is notched at 91 for the leftward position of the boss 138*a*, includes a bottom panel 92 which is secured to the base plate 30 by fasteners not shown. A pair of spaced sidewalls 94, one of which is shown, rises up from the bottom panel. Between the sidewalls 94 three spaced pins 96, 98 and 100 are mounted. Rightward of the sidewalls 94 a second pair of walls 104, one of which is shown, is struck up also from panel 92 and mounts between them pin 104.

The main latch 106 is mounted to pivot on pin 96, and includes an integral nose 106*a* which extends rearwardly from pin 96 and features a curved working surface 106*b*. A latch retractor 108 is pivoted between its ends on pin 98 and is formed with an integral working surface 108*a* which works against surface 106*b*. The rightward en of retractor 108 is pinned for pivoting at 110 to link 112, which is, in turn, pinned for pivoting at 114 to the end of an arm 116*a* of an L-shaped "dog bone" assembly 116. A second leg 116*b* of the assembly terminates in a rounded drive head 116*c* beneath panel 92.

An auxiliary bolt 118 is pivoted on pin 96 and features a cam surface 118*a* on its downward lobe. Cooperating with the cam surface 118*a* is the follower 120*a* on the end of a deadlocking yoke 120 pivoted on pin 100. The deadlocking yoke includes the drive surface 120*b*, which is engaged by lip 108*b* on the retractor 108. Latch 106 is formed with a lateral pin 106*a*.

In the above latch assembly, coil springs having suitable arms are provided to bias the elements in desired directions. Spring 122 surrounds pin 96 and its arms engage pin 98 and pin 106*a* respectively to bias the main latch 106 outward. Spring 124 also surrounds pin 96 and has arms which engage respectively against pin 98 and notch 118*b* to bias the auxiliary bolt outward. Spring 126 surrounds pin 100 and engages pin 98 and lateral ear 120*c* on the deadlocking yoke to bias the yoke 120 with follower 120*a* pressing upward against cam surface 118*a*.

In operation, the above assembly is activated by the rightward movement of the head 116*c*. The sequence is as follows. Arm 116*a*, integral with arm 116*b*, drives the link 112 downward, rotating retractor 108 clockwise. Lip 108*b*, working against surface 120*b* on the yoke 120, lowers the leftward end of the yoke (FIG. 9) to remove it from the path of pin 106*a*. The upward movement of surface 108*a* works against curve surface 106*b* to drive the main latch inward. Subsequently when the head 116*c* is permitted to shift back to the left (FIG. 8), as will be described, spring 122, in engagement with pin 106*c*, urges the latch 106 outward.

When the door is closed and the latch 106 extended in its keeper, and the auxiliary bolt is held inward by the side of the keeper as conventional, the cam surface 118*a*, engaged by follower 120*a*, permits the yoke 120 to rise. This blocks any attempt to force latch 106 inward, because the end of yoke 120 is, under the conditions described, in the path of pin 106*c*.

In normal latching operation, as the door swings closed, the keeper depresses both main latch 106 and auxiliary bolt 118. However, latch 106 is depressed first and pin 106*c* clears the yoke 120 before auxiliary bolt 118 moves inward to permit the yoke to rise as follower 120*a* follows cam 118*a*.

It will be clear from the art that the rim latch mechanism described above can be replaced by floor and ceiling latches. Specifically, retractor 108 can be made, through a pivoted intervening link (not shown), to raise rods to actuate such latches as the retractor 108 pivots.

Figure 3:
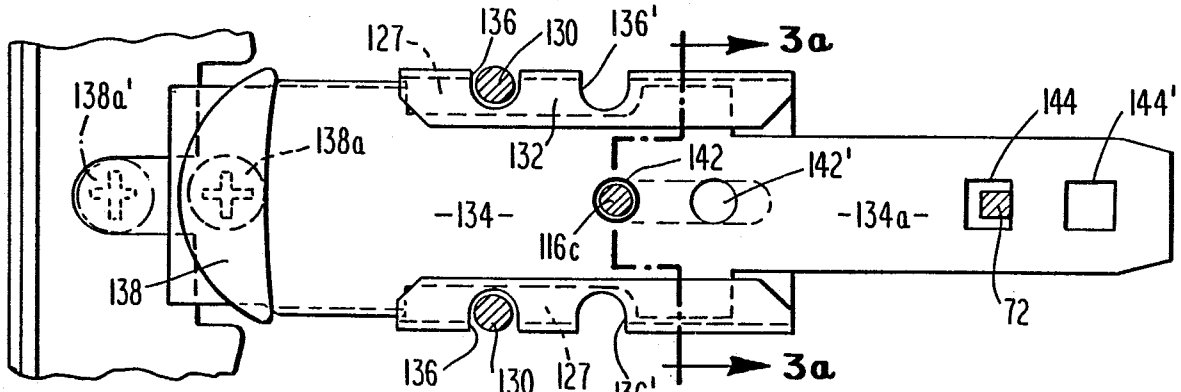
FIG. 3 is an enlarged view taken on the line 3—3 of FIG. 1 and showing in phantom the alternate position of the drive boss under a different backset.
Figure 3A:
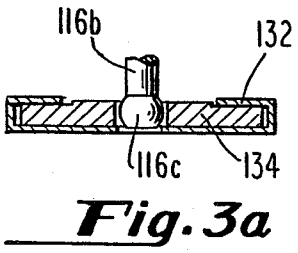
FIG. 3*a* is a sectional view taken on the line 3*a*—3*a* of FIG. 3.

Focusing now on the means for arranging for an adjustable backset, attention is directed to FIGS. 3 and 3*a*. Bolts 130 secure a C-shaped housing 132 to the underside of the base plate 30. Housing 132 slideably encloses a drive plate 134 (FIG. 3*a*) formed with a reduced tail 134*a*. With the shield 18 removed and prior to the device being installed on the door, the housing 132 and plate 134 may be removed from the base plate 30 by unscrewing bolts 130, which are disposed in notches 136 in the housing. The housing may then be shifted leftwardly (FIG. 3) and rebolted, the bolts 130 fitting into the same holes in base plate 30 but received in different notches 136' in the housing 132. This replacement changes the backset distance, as will be explained. The plate 134 is cut away at 127 under the lips of the housing to not interfere with the bolts 130 in whatever notch 136 or 136' they engage.

Figure 2:
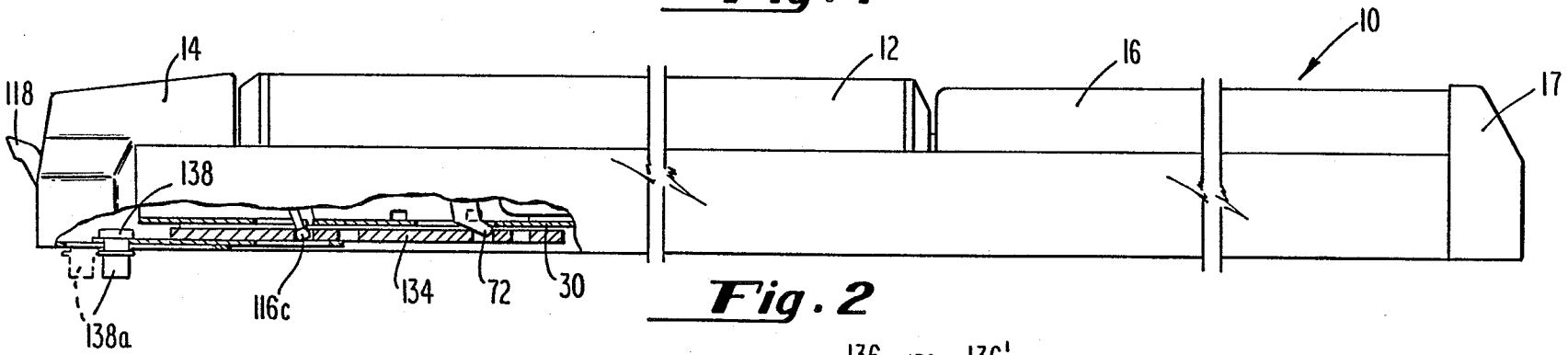
FIG. 2 is similar to FIG. 1, showing the touch bar depressed and the latch retracted.

As shown in FIGS. 1 and 2, the panel of the housing 132 on the opposite side of plate 134 from the base plate 30 extends leftwardly. At its leftward end it is apertured to journal the drive boss 138*a* of a cam element 138. A retaining ring surrounding the boss keeps the element from working up in its opening.

As shown in FIG. 3, the cam element 138 integrally molded with the boss is in the form of a crescent moon which rides against the curved end of plate 134.

As shown, plate 134 is apertured as at 142 and 142' for the rounded element 116*c* selectively, and at 144 and 144' for the finger 72 selectively. It will be understood that, depending on the backset distance desired, the boss 138*a* will be positioned at the desired backset, and the elements 116*c* and 72 received into the appropriate set of apertures. The housing 132 will be then bolted to the base plate either through notches 136 or 136'.

With the boss 138*a* at the desired distance from the edge of the door—note the alternate positions 138*a* and 138*a'* in FIGS. 2 and 3—the handle and rim cylinder may be installed on the opposite side of the door at the appropriate backset distance, with the drive tail of the cylinder aligned with and extending into the cross slot (FIG. 3) on the boss 138*a*.

In operation, with the exit device installed on the door and the exterior operating means connected, as described above, the latch 106 can be operated from the outside of the door. Specifically, when the handle or key outside the door is turned, boss 138*a* and the crescent-moon-shaped cam 138 rotate, one of its lobes pressing the drive plate 134 to slide it rightwardly (FIG. 1), driving the rounded element 116*c* to the right (FIG. 1) and operating the latch 106, as described. The movement of the plate in this fashion by external operating means does not cause depression of the touch bar 12 because of the lost motion permitted by slot 78 on the pusher 70. This makes the movement of the operator easier than if the touch bar also had to be moved with the latch.

Operation of the latch from inside the building is achieved, of course, by depressing the touch bar, which moves the finger 72 rightwardly (FIG. 1), as described. This movement causes rightward movement also of the plate 134, which moves the rounded element 116*c* rightward to retract the latch. When the touch bar 12 is subsequently released from the manual pressure, it pops out to the position shown in FIG. 1 due to the force of the spring 58 (FIG. 4) and the leftward urging on the drive plate 134 (FIG. 4) resulting from the action of spring 122 and spring 128, both of which urge element 116*c* leftward. The latter causes the plate 134 to return to its home position against the cam 140.

Figure 7:
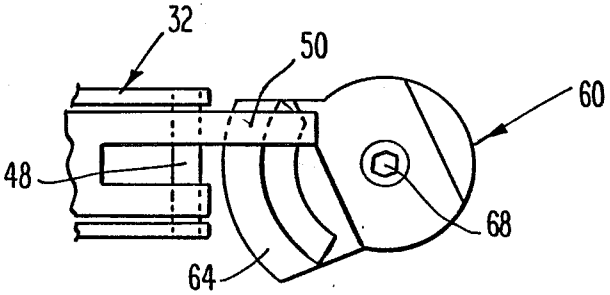
FIG. 7 is an enlarged sectional view taken on the line 7—7 of FIG. 4.

As already described, the dogging cam 60 (FIG. 7) may be rotated by an Allen wrench through opening 66, engaging the Allen wrench-shape hole 68 on the axis of rotation of cam 60. Alternatively a lock cylinder may be mounted on the cover plate 16 in an opening enlarged from opening 66. The "cam" or drive element of such a cylinder will, as the key is rotated one way or the other, alternately engage the opposite side surfaces of the wing of dogging cam 60 which carries the surface 64. Such a cylinder will have its drive lever mated into recess 69 in the cam 60. Activating the cam 60 causes the projection 50 to be held up, holding the touch bar in its inner position with finger 72 retracting the latch. In such a state the door may be freely opened from either side, being biased toward the closed position only by the door closer mounted at the top of the door, which does not constitute part of this invention.

In the embodiment described, the present invention is notable for its provision of means to adjust to different backset dimensions. Additionally, the simplicity of the linkages and sturdiness of the overall construction make the product suitable particularly for public use. It should be understood that variations are envisioned, and therefore the invention is not limited to the specific embodiment described and shown. It is limited only by the scope of the following claim language and equivalents thereof.

I claim:

1. An exit device comprising a base plate secured to one side of a door, a touch bar mounted on the base plate for rectilinear movement toward and away from the base plate, spring means biasing the touch plate away from the base plate, a latch assembly mounted at one end of the base plate and including a latch mounted for pivotal movement at a position adjacent the edge of the door, and actuating means connected to the touch bar and terminating in a finger under the base plate and adapted to move the finger when the touch bar is pressed, the latch assembly comprising a retracting linkage connected to the latch and terminating at its opposite end in a projection under the base plate spaced from the finger, an exterior operator mounted on the opposite side of the door and extending through the door, an apertured drive plate under the base plate and receiving in its apertures respectively the finger and the projection for movement together with the drive plate, cam means adjacent the drive plate and connected to the operator, the cam means being adapted when the operator is moved to shift the drive plate along the base plate, the cam means and the drive plate being positionable in a plurality of locations on the base plate so that the device can accommodate different backset distances for the exterior operator.

2. An exit device as claimed in claim 1 wherein the drive plate is a flat plate slideably disposed in a housing mounted against the base plate and the cam means rotates in the housing and has coupling means in mating relationship with the operator and the cam means rotates when the exterior operator is turned to shift the drive plate.

3. An exit device as claimed in claim 2 wherein the coupling means comprises a molded boss on the cam means engaged by the operator and the distal end of the cam means engages the drive plate.

4. An exit device as claimed in claim 2 wherein spaced mounting means mount the touch bar on the base plate and having slots therein and the touch bar has transverse pins passing freely through the slots respectively and the finger is pivotally mounted on one of the mounting means, and a pusher element is connected between one of the pins and the finger at a point spaced from the pivotal mounting of the finger whereby when the touch bar is pressed, the pusher element pivots the finger.

5. An exit device as claimed in claim 1 wherein the retracting linkage for the latch comprises an arm extending rigidly from the latch in a direction beyond the pivot, and a lever pivoted at its center and having an end engaging the arm on the latch, the said end and the arm each having convex surfaces rolling against each other as the lever pivots.

6. An exit device as claimed in claim 5 including also a keeper for the latch and wherein the latch is formed with a blocking pin disposed parallel to its axis but spaced therefrom and a blocking leg is pivoted in the assembly and blocks the inward movement of the pin when the latch is housed in the keeper, the convex surface on the lever engaging the leg to move it away from the path of the pin as retraction of the latch by the retracting linkage commences.

7. An exit device as claimed in claim 6 wherein an auxiliary latch is provided and pivoted at the same pivot as the first-identified latch and when the auxiliary latch is not depressed it permits the leg to be out of the path of the pin and when it is depressed by the keeper it engages the blocking leg to position it in the way of the pin until the retraction of the latch by the retracting linkage.

8. An exit device comprising a base plate adapted to be secured to one side of a door, a touch bar mounted on the base plate for rectilinear movement toward and away from the base plate, spring means biasing the touch plate away from the base plate, a latch assembly mounted at one end of the base plate and including a latch mounted for pivotal movement at a position adjacent the edge of the door, and actuating means connected to the touch bar and terminating in a finger adjacent the base plate and adapted to move the finger when the touch bar is pressed, the latch assembly comprising a retracting linkage connected to the latch and terminating at its opposite end in a projection adjacent the base plate spaced from the finger, an exterior operator adapted to be mounted on the opposite side of the door and extending through the door, an apertured drive plate adapted to move longitudinally of the base plate and receiving in its apertures respectively the finger and the projection for movement together with the drive plate, cam means adjacent the drive plate and connected to the operator, the cam means being adapted when the operator is moved to shift the drive plate longitudinally with respect to the base plate, the cam means and the drive plate being positionable in a plurality of locations relative to the base plate so that the device can accommodate different backset distances for the exterior operator.

9. An exit device comprising a base plate secured to one side of a door, a touch bar mounted on the base plate for rectilinear movement toward and away from the base plate, spring means biasing the touch late away from the base plate, a latch assembly mounted at one end of the base plate and including a latch mounted for pivotal movement at a position adjacent the edge of the door, and actuating means connected to the touch bar and terminating in a finger adjacent the base plate and adapted to move the finger when the touch bar is pressed, the latch assembly comprising a retracting linkage connected to the latch and terminating at its opposite end in a projection adjacent the base plate spaced from the finger, an exterior operator mounted on the opposite side of the door and extending through the door, an apertured drive plate adapted to move longitudinally of the base plate and receiving in its apertures respectively the finger and the projection for movement together with the drive plate, cam means adjacent the drive plate and connected to the operator, the cam means being adapted when the operator is moved to shift the drive plate longitudinally with respect to the base plate, the cam means and the drive plate being positionable in a plurality of locations along the base plate so that the device can accommodate different backset distances for the exterior operator.

* * * * *